US011624480B2

(12) United States Patent
Lauvdal et al.

(10) Patent No.: US 11,624,480 B2
(45) Date of Patent: Apr. 11, 2023

(54) PETROLEUM PRODUCTION PROCESS SYSTEM AND METHOD OF OPERATION

(71) Applicant: AKER SOLUTIONS AS, Lysaker (NO)

(72) Inventors: Anders Lauvdal, Oslo (NO); Tylar Paul Bunger, Nittedal (NO)

(73) Assignee: AKER SOLUTIONS AS, Lysaker (NO)

( * ) Notice: Subject to any disclaimer, the term of this patent is extended or adjusted under 35 U.S.C. 154(b) by 68 days.

(21) Appl. No.: 17/054,528

(22) PCT Filed: May 13, 2019

(86) PCT No.: PCT/NO2019/050107

§ 371 (c)(1),
(2) Date: Nov. 11, 2020

(87) PCT Pub. No.: WO2019/221608

PCT Pub. Date: Nov. 21, 2019

(65) Prior Publication Data

US 2021/0116075 A1 Apr. 22, 2021

(30) Foreign Application Priority Data

May 14, 2018 (NO) ..... 20180680

(51) Int. Cl.
*F17D 3/10* (2006.01)
*E21B 43/01* (2006.01)

(52) U.S. Cl.
CPC ..... *F17D 3/10* (2013.01); *E21B 43/01* (2013.01)

(58) Field of Classification Search
CPC ..... F17D 3/10; E21B 43/01
USPC ..... 137/13
See application file for complete search history.

(56) References Cited

U.S. PATENT DOCUMENTS

| | | | | |
|---|---|---|---|---|
| 9,032,987 | B2 * | 5/2015 | Bjorge | F04D 25/0686 417/89 |
| 9,901,847 | B2 * | 2/2018 | Høydal | B01D 45/12 |
| 2011/0139625 | A1 * | 6/2011 | Arntzen | B01D 19/0036 204/662 |
| 2011/0203460 | A1 | 8/2011 | Skofteland et al. | |
| 2012/0055335 | A1 | 3/2012 | Mateman et al. | |

(Continued)

FOREIGN PATENT DOCUMENTS

| | | |
|---|---|---|
| EP | 2 799 716 A2 | 11/2014 |
| GB | 2 242 373 A | 10/1991 |

(Continued)

*Primary Examiner* — Matthew R Buck
*Assistant Examiner* — Patrick F Lambe
(74) *Attorney, Agent, or Firm* — Norman B. Thot

(57) ABSTRACT

A process system includes a process module, an upstream pipe, a downstream pipe, an inlet pipe with an inlet isolation valve, an outlet pipe with a discharge isolation valve, a bypass with a bypass isolation valve, and a drainage line with a valve. The process module has an inlet, an outlet, and a drainage outlet. The inlet pipe fluidically connects the inlet of the process module to the upstream pipe. The outlet pipe fluidically connects the outlet of the process module to the downstream pipe. The bypass fluidly connects the upstream pipe and the downstream pipe via the bypass isolation valve. The drainage line fluidly connects the drainage outlet of the process module to the downstream pipe via the valve.

9 Claims, 4 Drawing Sheets

(56) References Cited

U.S. PATENT DOCUMENTS

| | | | | |
|---|---|---|---|---|
| 2014/0290753 | A1 | 10/2014 | Grimstad et al. | |
| 2014/0305539 | A1 | 10/2014 | Stinessen | |
| 2017/0234098 | A1 | 8/2017 | Bjørkhaug | |
| 2018/0003342 | A1* | 1/2018 | Kunkel | F17C 1/00 |
| 2019/0285229 | A1 | 9/2019 | Stuedal et al. | |

FOREIGN PATENT DOCUMENTS

| | | | | |
|---|---|---|---|---|
| GB | 2242373 | A * | 10/1991 | B01D 17/0211 |
| WO | WO 2011/008103 | A1 | 1/2011 | |

* cited by examiner

PETROLEUM PRODUCTION PROCESS SYSTEM AND METHOD OF OPERATION

CROSS REFERENCE TO PRIOR APPLICATIONS

This application is a U.S. National Phase application under 35 U.S.C. § 371 of International Application No. PCT/NO2019/050107, filed on May 13, 2019 and which claims benefit to Norwegian Patent Application No. 20180680, filed on May 14, 2018. The International Application was published in English on Nov. 21, 2019 as WO 2019/221608 A1 under PCT Article 21(2).

FIELD

The present invention relates to a process system and to a method of operating a process system, such as a process system for handling fluids in petroleum production plants.

BACKGROUND

Subsea and topside offshore production and processing systems are continually being developed, in part due to the petroleum industry moving to exploit more remote fields where locating equipment subsea or on a minimum-manned platform is the most cost-efficient or otherwise desirable option. This provides a number of challenges since such equipment may not be readily accessible for maintenance or repairs, or because no permanent operators are on site to perform such maintenance or repairs. There are consequently demanding requirements on such equipment for high reliability and long service life, and operational procedures seek to ensure that the equipment is operated in the most optimal manner to avoid unexpected disturbances or, for example, a need to retrieve equipment for maintenance or repairs.

Drainage of equipment (such as compressors) and piping in process systems (such as a compression station) is often required prior to start-up or after shut-down. This is usually performed either by gravity or by pumps, whereby liquids in the equipment units drains by gravity to a lower location or is pumped out of the equipment.

Publications which may be useful to understand the background of the present invention include WO 2013/026776, WO 2010/102905, WO 2013/062419, EP 2 799 716, WO 2011/008103, NO 341495, and WO 2016/028158.

SUMMARY

An aspect of the present invention is to provide further improved systems and methods in this area, or at least alternatives to known technology.

In an embodiment, the present invention provides a process system which includes a process module, an upstream pipe, a downstream pipe, an inlet pipe comprising an inlet isolation valve, an outlet pipe comprising a discharge isolation valve, a bypass comprising a bypass isolation valve, and a drainage line comprising a valve. The process module comprises an inlet, an outlet, and a drainage outlet. The inlet pipe fluidically connects the inlet of the process module to the upstream pipe. The outlet pipe fluidically connects the outlet of the process module to the downstream pipe. The bypass fluidly connects the upstream pipe and the downstream pipe via the bypass isolation valve. The drainage line fluidly connects the drainage outlet of the process module to the downstream pipe via the valve.

BRIEF DESCRIPTION OF THE DRAWINGS

The present invention is described in greater detail below on the basis of embodiments and of the drawings in which.

DETAILED DESCRIPTION

The present invention provides a process system comprising a process module, wherein an inlet of the process module is fluidly connected to an upstream pipe via an inlet pipe having an inlet isolation valve, and wherein an outlet of the process module is fluidly connected to a downstream pipe via an outlet pipe having a discharge isolation valve. The process system comprises a bypass fluidly connecting the upstream pipe and the downstream pipe via a bypass isolation valve, and a drainage line fluidly connecting a drainage outlet of the process module to the downstream pipe via a valve.

These and other characteristics of the present invention will become clear from the following description of illustrative embodiments, which are provided as non-restrictive examples, under reference to the attached drawings.

Figure 1:
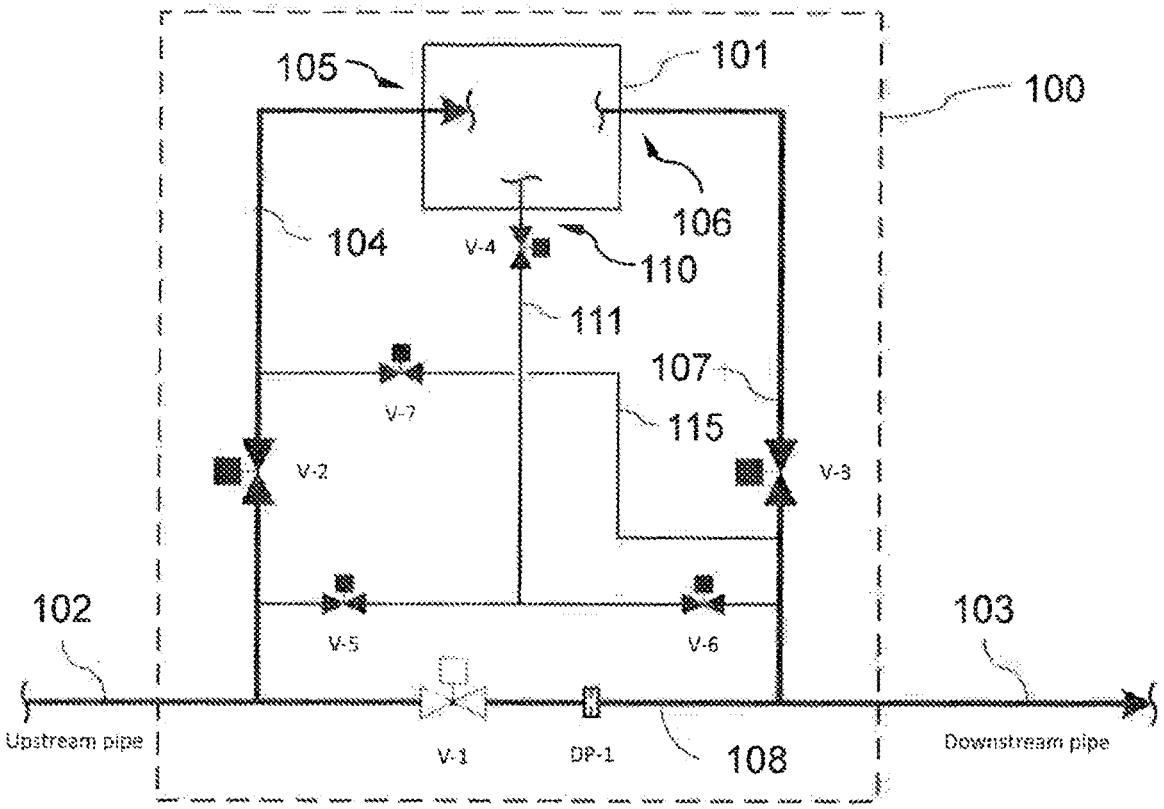
FIG. 1 shows a schematic illustration of a process system according to an embodiment of the present invention.

FIG. 1 shows a process system 100 according to an embodiment of the present invention. The process system 100 is part of a petroleum production facility and comprises a process module 101 and a drainage system to facilitate draining of the process module 101, for example, prior to start-up or after shut-down.

The process system 100 may be a subsea process system or a topside process system. A topside process system according to embodiments of the present invention may, for example, be suitable for so-called minimum-manned or unmanned platforms. The process system 100 may be remotely operated.

The process module 101 may, for example, be a gas compressor, fluid processing assemblies, vessels, distribution manifolds, or another process system component which may require draining.

The process system 100 is connected to a production pipeline 102,103 which may, for example, carry a flow of multiphase fluids. An upstream part 102 of the production pipeline is connected to an inlet 105 of the process module 101 via an inlet pipe 104. An inlet isolation valve is operable to selectively close the inlet pipe 104 between the upstream part 102 and the inlet 105.

An outlet pipe 107 is arranged between an outlet 106 of the process module 101 and a downstream part 103 of the production pipeline. A discharge isolation valve V-3 is arranged in the outlet pipe 107 and is operable to selectively close the outlet pipe 107 between the outlet 106 and the downstream part 103. In operation, process fluids flowing through the upstream part 102 may be led to the inlet 105, flow through the process module 101 for processing (e.g., pressure boosting), and flow via the outlet 106 to the downstream part 103 and to, for example, a storage or another plant for further processing of the fluids.

A bypass 108 connects the upstream part 102 and the downstream part 103. The bypass 108 comprises a bypass isolation valve V-1, arranged downstream of the inlet pipe 104 and upstream of the outlet pipe 107. When the bypass isolation valve V-1 is open, fluids may flow directly from the upstream part 102 to the downstream part 103 without entering the process module 101. This is the situation illustrated in FIG. 1, wherein the bypass isolation valve V-1 is open and the inlet isolation valve V-2 and the discharge isolation valve V-3 are closed. The bypass 108 further comprises a flow restriction element DP-1, the function of which will be described in further detail below. Not all embodiments may have the flow restriction element DP-1, as it may be omitted in some embodiments.

The process module 101 has a drainage outlet 110. The drainage outlet 110 is arranged to drain accumulated liquids from the process module 101, and may be connected to, for example, a drainage sump within the process module 101. A drainage line 111 leads from the drainage outlet 110 and is fluidly connected to the upstream part 102 via a drain-to-inlet valve V-5. In this embodiment, the drainage line 111 is connected to the inlet pipe 104 upstream of the inlet isolation valve V-2, however, the drainage line 111 may also be connected directly to the upstream part 102 or to the bypass upstream via the bypass isolation valve V-1.

The drainage line 111 is also fluidly connected to the downstream part 103 via a drain-to-discharge valve V-6. In this embodiment, the drainage line 111 is connected to the outlet pipe 107 downstream of the discharge isolation valve V-3, however, the drainage line 111 may also be connected directly to the downstream part 103 or to the bypass downstream of the bypass isolation valve V-1.

In this embodiment, the drainage line 111 is T-shaped, as can be seen in FIG. 1, and connects to both the upstream part 102 and to the downstream part 103 via the respective valves, however, two separate drainage lines may alternatively be used. A system drain valve V-4 is arranged upstream of the drain-to-inlet valve V-5 and the drain-to-discharge valve V-6, however, this is optional.

Certain embodiments, including that shown in FIG. 1, may further include a pressurization conduit 115 having a pressurization-from-discharge valve V-7 arranged therein. In this embodiment, the pressurization conduit 115 extends from the outlet pipe 107 downstream of the discharge isolation valve V-3 to the inlet pipe 104 downstream of the inlet isolation valve V-2, however, the pressurization conduit 115 may also extend from the bypass 108 downstream of the bypass isolation valve V-1 or from the downstream part, and may also extend directly to the inlet 105. The function of the pressurization conduit 115 is to provide selective fluid communication between the downstream part 103 and the inlet 105, as will be described in further detail below.

In FIG. 1, the bypass isolation valve V-1 is in the open position, as is illustrated in the conventional manner with white fill color in the schematic valve symbol, while all the other valves are closed, as is illustrated by a black fill color. In this operational setting, fluids from the upstream part 102 will flow through the (open) bypass isolation valve V-1, through the flow restriction element DP-1 (if used), and out through the downstream part 103. The fluids will in this configuration not be processed by the process module 101.

It may, for example, be that the process module 101 has recently been shut down or is about to be started up, and that a draining of liquids from the process module 101 is required.

Figure 2:
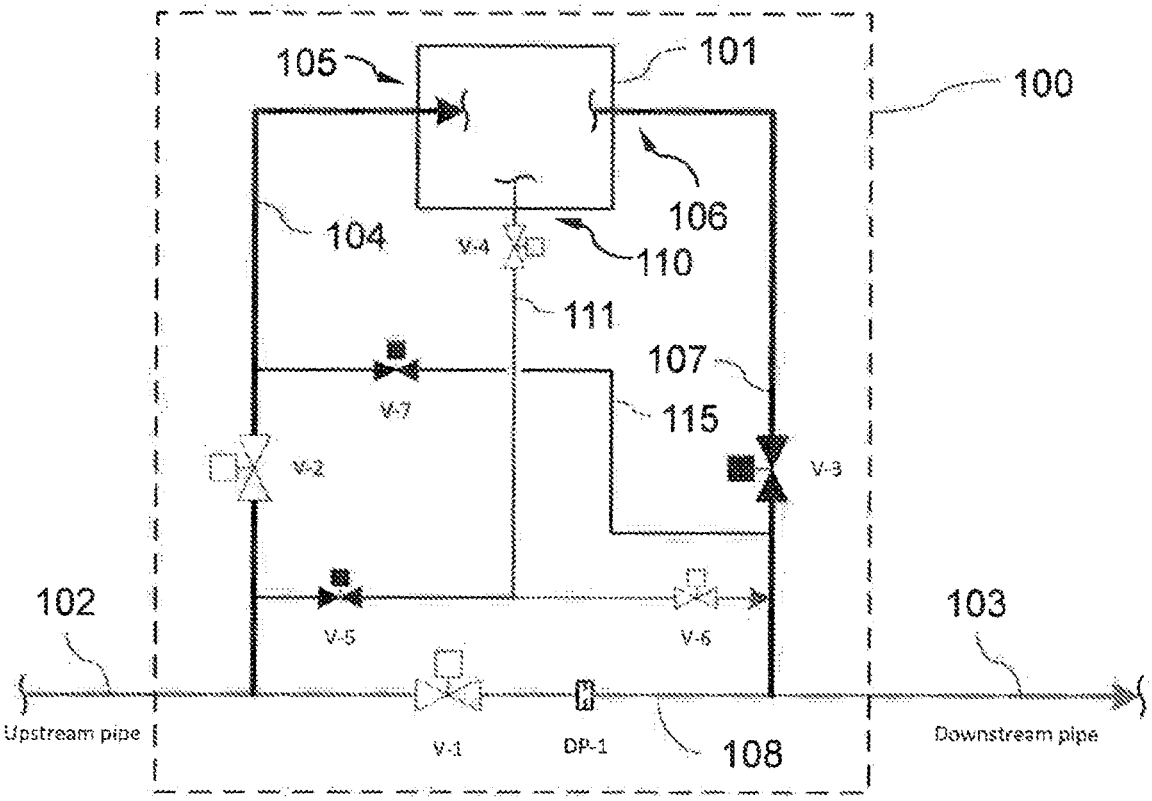
FIG. 2 shows the process system in a first operational mode.

FIG. 2 illustrates one method of operating the process system 100 to achieve this. In FIG. 2, the production pipeline 102,103 is producing a multiphase flow through the bypass isolation valve V-1. The flow restriction element DP-1 is configured to provide a design pressure drop across the flow restriction element DP-1, so that the fluid pressure in the downstream part 103 is lower than the fluid pressure in the upstream part 102. The flow restriction element DP-1 may, for example, be a throttle element or another element which is operable to partially restrict fluid flow through the bypass 108. The flow restriction element DP-1 may be a passive restriction (such as a flow orifice) or an actively controllable element (such as a control valve or controllable throttle).

Inlet isolation valve V-2 is open so as to pressurize the process module 101 with fluid from the upstream part 102 via the inlet 105. This fluid may be predominantly gas. The system drain valve V-4 and the drain-to-discharge valve V-6 are open. Due to the pressure differential, liquids in the process module 101 drain via the drainage line 111 to the downstream part 103 downstream of the flow restriction element DP-1, and drained liquid is removed. The arrangement according to this embodiment consequently achieves a flow pressure drop assisted draining of the process module 101.

Figure 3:
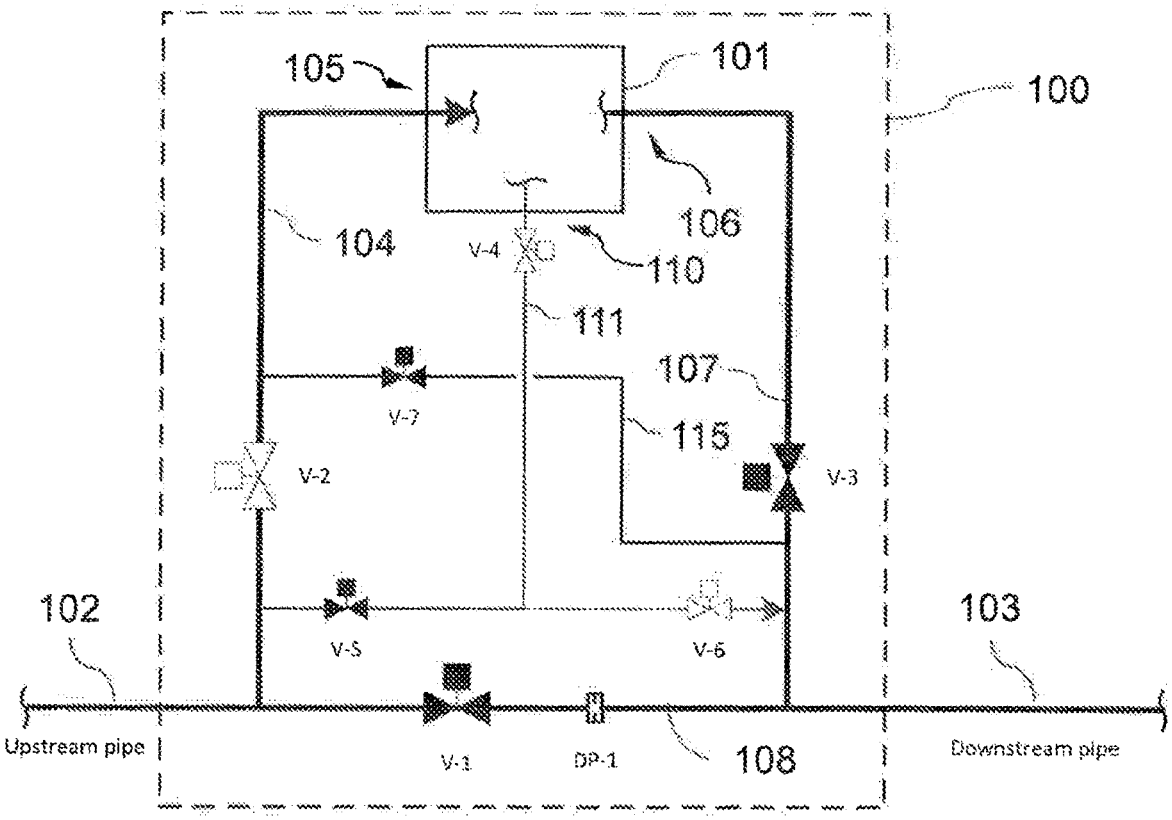
FIG. 3 shows the process system in a second operational mode.

FIG. 3 illustrates another operational configuration. In this scenario, the process system 100 is shut down and there is no flow through the bypass isolation valve V-1. The fluid pressure in the upstream part 102, i.e., upstream of bypass isolation valve V-1, is higher than in the downstream part 103. According to this embodiment, the pressure differential is utilized to assist draining of the process module 101 to the downstream part 103. Inlet isolation valve V-2 is open so as to provide fluid communication between the upstream side 102 and the inlet 105. The system drain valve V-4 and the drain-to-discharge valve V-6 are open. Fluid from the upstream part 102 may thereby displace drain liquids from the process module 101, which drain to the downstream part 103. Such "suction pressure assisted" draining may thus be used in a scenario where the process system 100 is shut down and there is a pressure differential with a higher pressure on the upstream side than on the downstream side.

Figure 4:
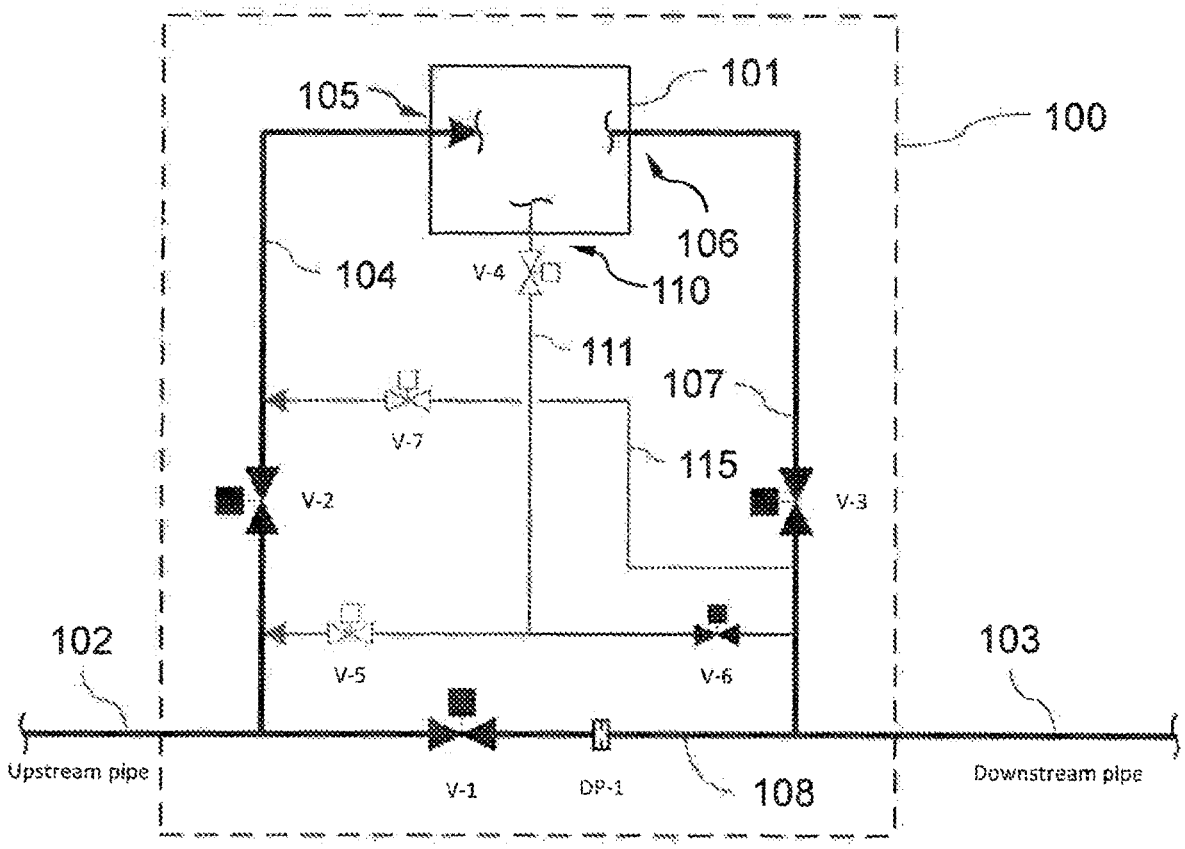
FIG. 4 shows the process system in a third operational mode.

FIG. 4 illustrates another scenario which is similar to the scenario illustrated in FIG. 3, but in this case with a pressure differential during a shutdown state in which the pressure on the downstream side is higher than on the upstream side. This may be the case in practice due to an external influence or because of the state of other elements in the overall installation and production facility.

In this scenario, the process system is shut down as in FIG. 3, and there is no flowing production through the bypass isolation valve V-1. The fluid pressure downstream of the bypass isolation valve V-1, i.e., on the downstream part 103, is higher than that in the upstream part 102. This pressure difference is utilized to drain the process module 101 to the upstream part 102. Pressurization-from-discharge valve V-7 is open so as to pressurize the inlet 105 of the process module 101 with fluid, for example, a substantially pure gas, from the downstream part 103. The system drain valve V-4 and the drain-to-inlet valve V-5 are open. Fluid from the downstream part 103 may thereby displace drain liquids from the process module 101, which drain to the upstream part 102. Such "discharge pressure assisted" draining may thus be used in a scenario where the process system 100 is shut down and there is a pressure differential with a higher pressure on the downstream side than on the upstream side.

According to embodiments described herein, draining of process modules can be carried out without the aid from a pump or gravitational requirements, or to assist a pump or gravitational drainage system so as to obtain, for example, increased reliability or reduced design requirements for such pump or gravitational systems. Significant savings in weight and cost of the overall process system 100 can, for example, be provided by relaxing elevation requirements or drainage pump requirements.

All operational methods may comprise first establishing that a pressure in one part of the system is higher than in another part of the system before carrying out the steps for draining the process module 101. For example, in the embodiment described in relation to FIG. 4, establishing that the pressure in the downstream part 103 is higher than that in the upstream pipe 102.

In any of the embodiments, the fluid provided to the inlet 105 may be a substantially pure gas, a wet gas, or a multiphase fluid comprising liquids and gas. The fluid drained through drainage outlet 110 will normally be predominantly a liquid, but can be a liquid with gas fractions and/or a multiphase fluid. The fluid provided to the inlet 105 for driving the drainage process may be obtained from the production pipeline 102,103 in various ways, depending on the circumstances and operational conditions. If the production pipeline 102,103 handles mainly gas, a gas or gas-rich fluid for this purpose can be retrieved directly from the production pipeline 102,103. If the production pipeline 102,103 handles multiphase fluids, a gas or a gas-rich fluid may be obtained, e.g., by elevated placement of the take-off point in the production pipeline 102,103. If necessary, a separator unit may be arranged in relation to this fluid to provide a high gas fraction of the fluid used for draining.

If the process system 100 and/or the process module 101 is being prepared for a period of non-use (for example, for maintenance or where the module 101 or system 100 is periodically not required to operate), the fluid provided may alternatively be an inert gas, such as nitrogen. The inert gas may be provided via the upstream part 102 or the downstream part 103. Purging or flushing of the process module 101 may thereby be carried out with an inert gas suppled from a downstream side of the production pipeline 102,103 (compare FIG. 4 and the associated description above) or with an inert gas supplied from an upstream side of the production pipeline 102,103 (compare FIG. 3).

The different operational configurations and the elements described in relation to FIGS. 1-4 may be applied individually if the operating requirements so dictate. The flow restriction element DP-1 may, for example, be omitted if pressure drop assisted draining is not necessary (or not practicable) in a given application. The pressurization conduit 115 may similarly be omitted if discharge pressure assisted draining is not required. An implementation of embodiments according to the present invention may therefore not necessarily comprise all the features or elements shown in the drawings to achieve the desired technical effects. The present invention is consequently not limited by the embodiments described above; reference should be had to the appended claims.

LIST OF REFERENCE NUMERALS

100 Process system
101 Process module
102 Upstream part (of production pipeline)
103 Downstream part (of production pipeline)
104 Inlet pipe
105 Inlet
106 Outlet
107 Outlet pipe
108 Bypass
110 Drainage outlet
111 Drainage line
115 Pressurization conduit
DP-1 Flow restriction element
V-1 Bypass isolation valve
V-2 Inlet isolation valve
V-3 Discharge isolation valve
V-4 System drain valve
V-5 Drain-to-inlet valve
V-6 Drain-to-discharge valve
V-7 Pressurization-from-discharge valve

What is claimed is:

1. A process system comprising:
a process module comprising an inlet, an outlet, and a drainage outlet;
an upstream pipe;
a downstream pipe;
an inlet pipe comprising an inlet isolation valve, the inlet pipe fluidically connecting the inlet of the process module to the upstream pipe;
an outlet pipe comprising a discharge isolation valve, the outlet pipe fluidically connecting the outlet of the process module to the downstream pipe;
a bypass comprising a bypass isolation valve, the bypass fluidly connecting the upstream pipe and the downstream pipe via the bypass isolation valve; and
a drainage line comprising a valve, the drainage line fluidly connecting the drainage outlet of the process module to the downstream pipe via the valve,
wherein,
the valve is a first valve,
the drainage line further comprises a second valve, and
the drainage line permits a fluid flow from the drainage outlet of the process module to the upstream pipe via the second valve via the drainage line being connected either,
directly to the upstream pipe, or
to the upstream pipe via a direct connection to the inlet pipe upstream of the inlet isolation valve, or
to the upstream pipe via a direct connection to the bypass upstream of the bypass isolation valve.

2. The process system as recited in claim 1, wherein the bypass further comprises a flow restriction element.

3. The process system as recited in claim 2, wherein the flow restriction element is a controllable flow restriction element operable to adjust a fluid flow rate therethrough.

4. The process system as recited in claim 1, wherein the process system is arranged subsea.

5. The process system as recited in claim 1, wherein the process system is arranged on an offshore platform.

6. The process system as recited in claim 1, further comprising:
a conduit comprising a third valve for controlling a fluid flow through the conduit, the conduit fluidly connecting the downstream pipe with the inlet of the process module.

7. A method of draining the process module arranged in the process system as recited in to claim 6, the method comprising simultaneously:
maintaining the bypass isolation valve, the inlet isolation valve, and the discharge isolation valve as closed;
flowing a gas from the downstream pipe to the inlet of the process module via the conduit; and
flowing a liquid from the drainage outlet of the process module to the upstream pipe via the drainage line.

8. A method of draining the process module arranged in the process system as recited in claim 1, the method comprising simultaneously:

flowing a production fluid from the upstream pipe to the downstream pipe via the bypass;

flowing a gas from the upstream pipe to the inlet of the process module via the inlet pipe; and flowing a liquid from the drainage outlet of the process module to the downstream pipe via the drainage line.

9. A method of draining the process module arranged in the process system as recited in claim 1, the method comprising simultaneously:

maintaining the bypass isolation valve and the discharge isolation valve as closed;

flowing a gas from the upstream pipe to the inlet of the process module via the inlet pipe; and flowing a liquid from the drainage outlet of the process module to the downstream pipe via the drainage line.

* * * * *